United States Patent [19]

Schowiak

[11] 4,005,825

[45] Feb. 1, 1977

[54] MIXING MANIFOLD FOR AIR ATOMIZING SPRAY APPARATUS

[75] Inventor: Duane C. Schowiak, Farmington Hills, Mich.

[73] Assignee: Ford Motor Company, Dearborn, Mich.

[22] Filed: Nov. 24, 1975

[21] Appl. No.: 634,971

Related U.S. Application Data

[62] Division of Ser. No. 525,596, Nov. 20, 1974, Pat. No. 3,924,806.

[52] U.S. Cl. ..... 239/413; 239/427.5; 239/428; 239/526; 239/571

[51] Int. Cl.[2] ..... B05B 7/12; B05B 7/04

[58] Field of Search ..... 239/8–10, 239/112, 113, 398, 400, 413, 416.1, 432, 419, 419.3, 419.5, 422, 427, 427.3, 427.5, 428, 525, 526, 571

[56] References Cited

UNITED STATES PATENTS

| | | | |
|---|---|---|---|
| 2,513,081 | 6/1950 | Clark et al. | 239/526 X |
| 3,093,316 | 6/1963 | Hedeman | 239/525 X |
| 3,240,432 | 3/1966 | Boettler | 239/112 X |
| 3,299,939 | 1/1967 | Marra | 239/419 X |
| 3,327,949 | 6/1967 | Eull | 239/413 X |
| 3,462,081 | 8/1969 | Gelin et al. | 239/112 X |
| 3,592,385 | 7/1971 | Smith | 239/10 |
| 3,690,557 | 9/1972 | Higgins | 239/112 |
| 3,759,450 | 9/1973 | Fram et al. | 239/427 |
| 3,795,364 | 3/1974 | Kattner | 239/8 |
| 3,850,371 | 11/1974 | Trapp | 239/113 |

*Primary Examiner*—Robert S. Ward, Jr.
*Attorney, Agent, or Firm*—Robert A. Benziger; Keith L. Zerschling

[57] ABSTRACT

A fluid mixing apparatus for association with an air atomizing spray gun is disclosed. The fluid mixing apparatus comprises a fluid manifold adapted for attachment to the handle of an air atomizing spray gun and includes static mixer means interconnecting the fluid manifold with the spray fluid inlet of the air atomizing spray gun. The fluid manifold comprises a fluid passage means interconnecting a plurality of inlet ports and communicating with an exit port which is connected to the static mixture means. The individual components of a multiple component sprayable fluid are separately introduced into the manifold through individual ones of the manifold inlet passages and are flowed through the manifold passage to be intimately intermixed by the static mixer means prior to being introduced into the sprayable fluid inlet port of the air atomizing spray gun.

7 Claims, 4 Drawing Figures

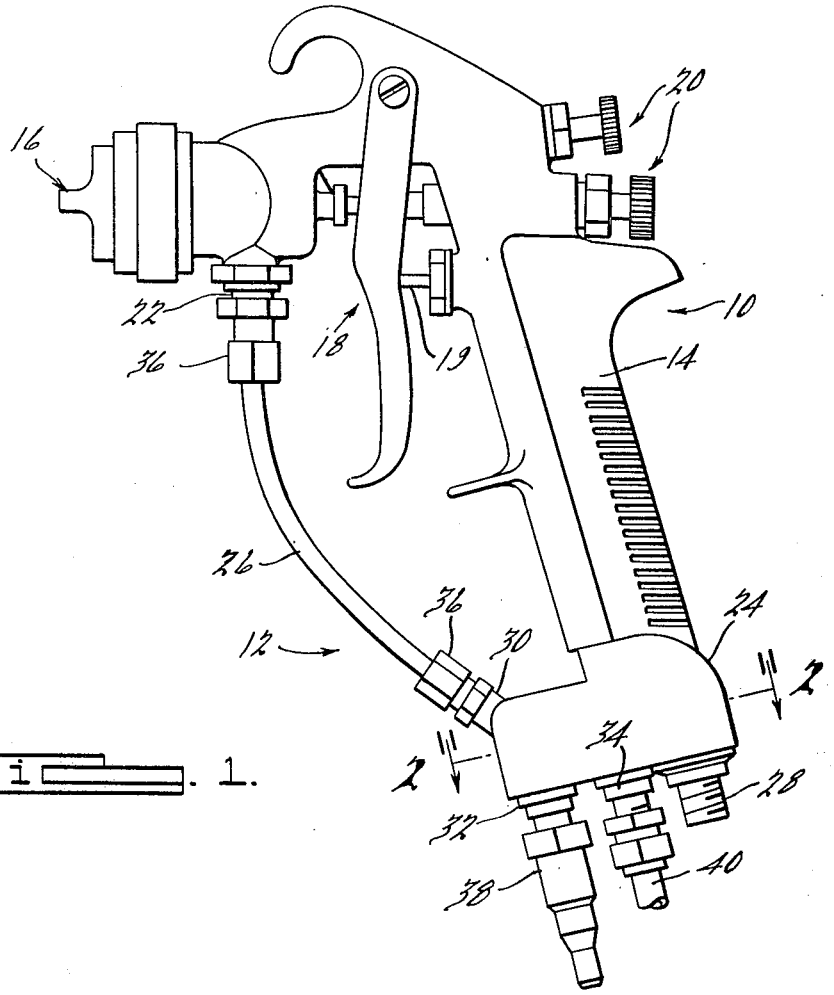
Fig. 1.
Fig. 2.
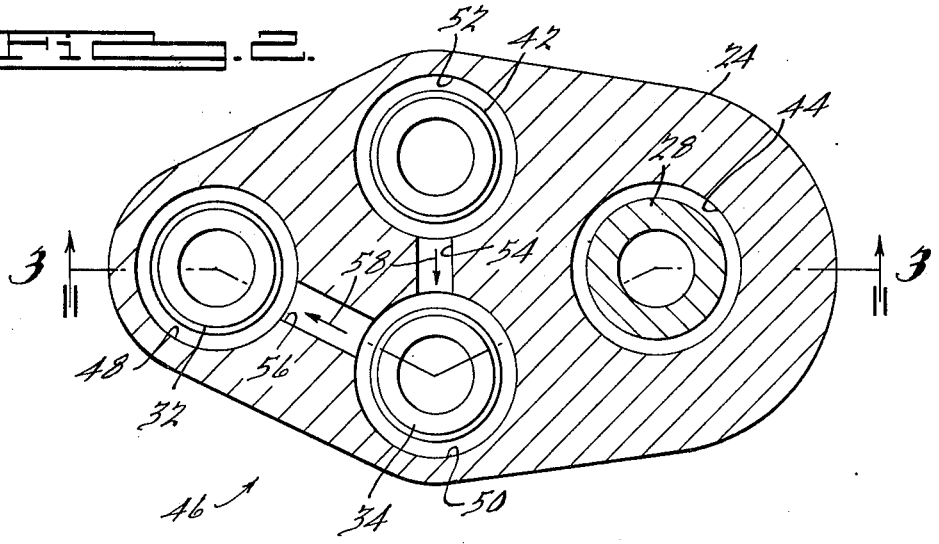

MIXING MANIFOLD FOR AIR ATOMIZING SPRAY APPARATUS

This is a division of application Ser. No. 525,596, filed Nov. 20, 1974, now U.S. Pat. No. 3,924,806.

BACKGROUND OF THE INVENTION

1. Field of the Invention

The present invention is directed to the field of apparatus for mixing the components of a multiple component sprayable fluid. More particularly, the present invention is directed to that portion of the above-noted field which is concerned with the mixing of a multiple component sprayable fluid wherein coreaction of the fluid components such as, for example, crosslinking will begin to occur immediately upon mixing. More particularly still, the present invention is directed to that portion of the above noted field which is concerned with the provision of sprayable fluids having a high percentage of solid material for use as coatings and wherein a color-providing component and a crosslinking component which may be color-free may be intermixed to provide for a coating having a selected color property and wherein crosslinking between the crosslinking component and the color-providing component will begin to occur immediately upon introduction of the color-providing component into the clear crosslinking component. More particularly still, the present invention is directed to that portion of the above-noted field which is concerned with the provision of apparatus for mixing the color-providing component and the crosslinking component of a multiple component color coating which will maintain a minimum quantity of intermixed components during use.

2. Description of the Prior Art

The recently experienced "energy crisis" has prompted extensive investigation by industry into the potentials for reducing energy consumption without materially or adversely affecting the quality or quantity of the goods and services provided. Substantial quantities of energy are consummed in the coatings applying industries in the operation of the ovens in which sprayed coatings are crosslinked.

Recently developed multiple component sprayable coatings appear to offer a potential for reducing oven temperatures, and hence energy consumption, without adverse affect to the quality of the finish or the time required for complete crosslinking of the coating. Examples of multiple component coatings are available under the names Polane from Sherwin-Williams Company, Inron From E. I. DuPont de Nemours and Company, and Akrylthane from Cook Paint and Varnish Company. These coating materials normally include a crosslinking "accelerator" which is capable of increasing the rate of crosslinking at any given temperature. A common accelerator is di-butyl 10 di-laurate, although others are known. By varying the quantity of accelerator present in a coating, the crosslinking rate may be varied. The presence of any of the accelerator induces a tendancy to crosslink at low, ambient, temperature necessitates the maintaining of the material in component form until immediately prior to application as a coating. However a practical upper limit of accelerator content has heretofore prevented any substantial reduction in oven energy expenditures.

As the crosslinking rate at ambient temperatures increases, the quantities of mixed presprayed, and hence crosslinking material also increases. Thus, it has been necessary to keep the quantity of mixed and presprayed multiple component material to a minimum. In those instances where the components are premixed, the quantity of premixed material has necessarily been very limited, for example, in quart quantities. It is therefore an object of the present invention to provide an improved spray apparatus to facilitate the use of sprayable coating materials having high crosslinking accelerator content in high volume mass-production coatings operations.

A further problem has been encountered with the use of such materials in coating operations requiring frequent color changes. In order to change color, substantial quantities of solvent must be expending in order to remove all vestiges of coating material, particularly crosslinked, from the spray apparatus. The greater the quantity of crosslinked material, the greater the quantity of solvent required. This is wasteful, both of solvent and of coating materials which tend to be very expensive in multiple component coatings. The large amounts of solvent used also greatly increases the amount of stationary source emissions contributing to atmospheric pollution. It is therefore a further and specific object of the present invention to provide such an improved spray apparatus which will maintain only very small quantities of presprayed multiple component coating materials in a mixed, and hence crosslinkable, condition.

Air atomizing spray guns are well known in the sprayable coatings field. Large numbers of such guns are in existence and in daily use. It is therefore a further object of the present invention to provide apparatus, or association with a conventional air atomizing spray gun, which will continuously and intimately intermix the components of a multiple component spray coating and which will result in only very small minimum quantities of mixed and yet to be sprayed fluid being present at any one time. More particularly, it is an object of the present invention to provide convenient apparatus for attachment to a conventional air atomizing spray gun which may receive separate fluid flows of the components of a multiple component sprayable coating and which will continuously mix these components and deliver them in a mixed state to the spray nozzle of the air atomizing spray gun. It is a further object of the present invention to provide such apparatus with means for easily cleaning the apparatus of mixed coating material to accomplish a change in the material being sprayed. It is a further object of the present invention to provide apparatus for addition, or attachment, to a conventional air atomizing spray gun which will not significantly increase the bulk or mass of the air atomiziing spray gun so as to avoid any significant alteration in the work requirements for such gun when applied to a manual spray operation.

SUMMARY OF THE PRESENT INVENTION

The present invention provides a fluid mixing manifold of comparatively small mass and size and which is adapted for attachment to the butt end of the hand grip portion of a conventional air atomizing spray gun. The manifold is attachable to the air atomizing spray gun through the conventional air hose connection and includes an air hose connection passage. The manifold further includes a fluid passage separate from the air hose connection passage and having a plurality of fluid inlet ports and a single fluid exhaust port. The fluid exhaust port is connected by means of a conventional static mixer to the sprayable fluid inlet passage of the air atomizing spray gun. The multiple fluid inlet ports for the manifold passage are spaced apart and are adapted to receive, variously, a solvent or flushing agent, the crosslinking component of the multiple component sprayable fluid coating and the color-providing component of the multiple component coating. Each of the inlet ports of the manifold passage is provided with a check valve means adapted to permit flow through the valve means into the manifold passage and to block fluid flow from the manifold passage through the check valve means. Some or all of the fluid inlet ports may be further provided with quick disconnect couplings to facilitate changing the fluids to be introduced through each port.

BRIEF DESCRIPTION OF THE DRAWING

FIG. 1 illustrates an elevational view of an air atomizing spray gun including the manifold and static mixer according to the present invention.

FIG. 2 illustrates a sectional view of the manifold of FIG. 1 taken along section line 2—2 of Flg. 1.

DETAILED DESCRIPTION OF THE PREFERRED EMBODIMENT

Figure 3:
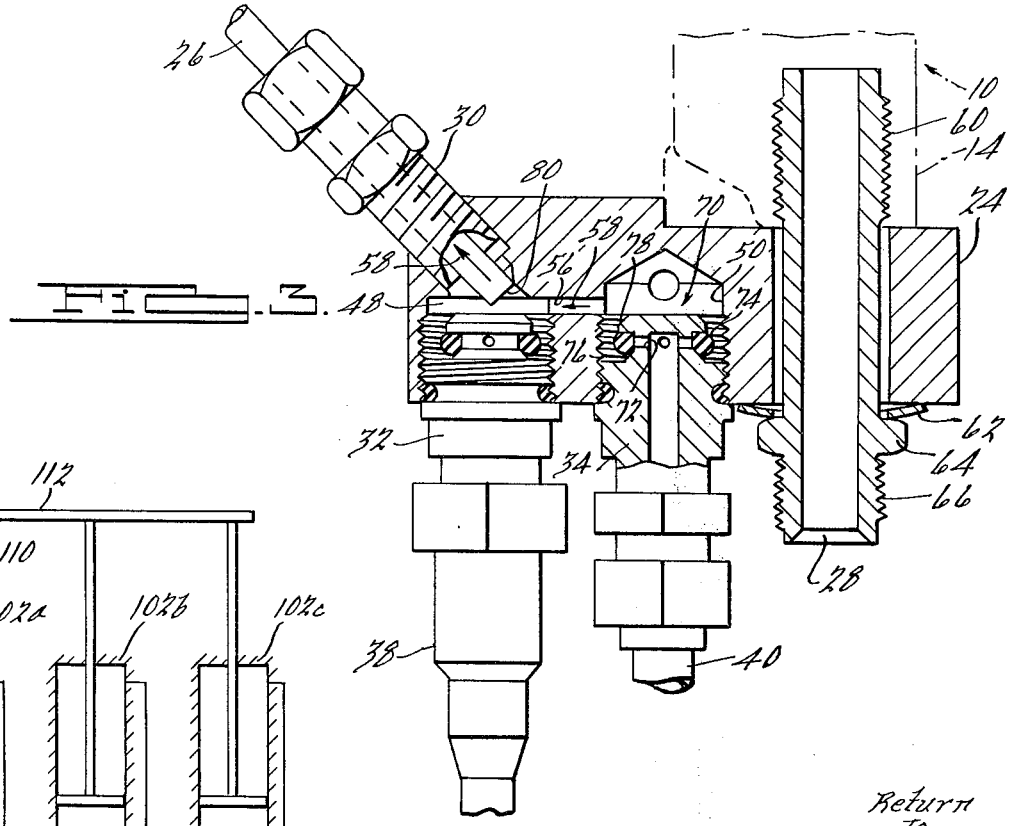
FIG. 3 illustrates a sectional view of the mixing manifold according to the present invention taken along section line 3—3 of Flg. 2.

Referring now to the drawing wherein like numbers designate like structure throughout the various views thereof, an air atomizing spray gun 10 having the mixing apparatus 12 of the present invention is illustrated. Air atomizing spray gun 10 may be, for example, a Devilbiss JGA air atomizing spray gun or a Binks Manufacturing Company air atomizing spray gun model 62. Such air atomizing spray guns are normally provided with a hand grip 14, a spray nozzle within air cap 16, a trigger-like actuation mechanism 18 and adjustment means 20. Furthermore, such guns are typically provided with a sprayable fluid inlet 22 and an air passage through grip 14 to communicate with nozzle. In operation, the actuation of the trigger-like mechanism 18 will displace a needle within an orifice to permit a flow of sprayable fluid to be expelled from air nozzle 16. Rearward movement of plunger 19 will permit pressurized air passage to flow through the spray nozzle 16. This pressurized air will cause the sprayable fluid, delivered under pressure to the sprayable fluid inlet 22, to become atomized and to be delivered as a fine spray gun 10.

The mixing apparatus 12 according to the present invention includes manifold member 24 which is in this case attached to the base of hand grip 14 and static mixer means 26. Static mixer means 26 is preferably a commercially available static mixer which is available through Kenics Corporation and is illustrated in U.S. Pat. Nos. 3,286,992 and 3,664,638. Such devices typically provide a plurality of variously positioned blade members or elements situated within a tube or conduit and arranged to cause the fluid flowing therethrough to swirl and to provide a large number of flow divisions so that the material will become intimately and thoroughly intermixed. Such devices are available in a variety of lengths to provide a variety of mixing actions.

Manifold member 24 may, as here illustrated, be attached to the normally provided air inlet port of air atomizing spray gun 10 and is therefore provided with means defining a through-passage and which includes an air inlet coupling 28. As here illustrated, manifold member 24 further includes an exit port 30 which is adapted for connection directly to an inlet coupling on static mixer 26. Manifold member 24 is also provided with a plurality of inlet couplings 32, 34 which will be discussed in greater detail hereinbelow. One end of static mixer 26 is connected through coupling member 36 to the sprayable fluid inlet 22 of the air atomizing spray gun 10. Manifold inlet coupling 32 of manifold member is illustrated in FIG. 1 as being connected to fluid conduit coupling 38 while manifold inlet coupling 34 is illustrated as being connected to fluid conduit 40. While not apparent from this view, but as shown in FIG. 2, a further fluid inlet coupling 42 is provided in alignment with the fluid inlet coupling 34. Fluid conduit coupling 38 is illustrated to be a portion of a portion of a quick disconnect type coupling to facilitate rapid color changes as be described hereinbelow with reference to FIG. 4.

Referring now to FIG. 2, an enlarged sectional view of the manifold member 24 according to the present invention and taken along section lines 2—2 of FIG. 1 is shown. Manifold member 24 is provided with through passage 44 and the air inlet coupling 28 for the air atomizing spray gun 10 is arranged to extend through the passage 44. Manifold member 24 is further provided with means defining a fluid flow passage 46. The first inlet coupling 32 is arranged to communicate with the flow passage means at first chamber 48. Second fluid inlet coupling 34 is arranged to communicate with flow passage means 46 at second chamber 50. Third inlet coupling 42 is arranged to communicate with the flow passage means 46 at third chamber 52. The second and third chambers 50, 52 are interconnected by flow passage 54 while the first and second chambers 48, 50 are interconnected by flow passage 56. Flow arrows 58 are provided to illustrate the direction of fluid flow through the various flow passages.

Referring now to FIG. 3, a sectional view of the mixing apparatus of the present invention taken along section line 3—3 of FIG. 2 is shown. Manifold member 24 is shown as being connected to the heel end of air atomizing spray gun 10, at hand grip 14, through the cooperative action of the end portion 60 of air inlet coupling 28 which is threadedly received within hand grip portion 14 and the resilient action of resilient means or spring washer 62 confined between manifold member 24 and shoulder 64 of the air inlet coupling 28. The air inlet coupling 28 includes a further threaded portion 66 which may receive a mating threaded portion of an air hose for air tight communication of the air hose with the spray gun air passage.

First and second fluid couplings 32, 34 are threadedly received within manifold member 24 in order to provide fluid tight communication between the associated manifold chambers 48, 50 and the fluid conduits which may be coupled to the first and second inlet couplings 32, 34. As illustrated, this is fluid conduit coupling 38 and fluid conduit 40. Fluid couplings 32, 34 are provided with check valve means 70 which are arranged to be operative to block fluid flow from the associated manifold chambers 48, 50 into the associated fluid conduits. Since it can be expected that substantially identical check valve means 70 will be utilized, only the check valve means 70 of fluid coupling 34 has been illustrated in a sectional view. In the presently preferred embodiment, check valve means 70 is comprised of a plurality of radially directed flow passages 72 emerging from fluid coupling member 34 and a radially expandible O-ring member 74. Fluid coupling member 34 also includes a conical section 76 in proximity to the flow passages 72 and an O-ring retaining cap member 78. When fluid pressure within the associated fluid conduit exceeds the pressure within the associated manifold chamber the O-ring member 74 will be radially expanded permitting fluid communication from the conduit to the chamber. An opposite pressure differential will compress O-ring member 74 into sealing engagement with conical seat section 76 and retaining cap member 78 to seal the associated fluid conduit from the associated fluid chamber. Other forms of check valves, such as the resiliently biased ball type check valve may also be used.

Manifold fluid exit coupling 30 is threadedly received within manifold member 24 and is arranged to have its inlet port 80 situated within manifold chamber 48 and angularly positioned to receive fluid flow from first inlet coupling 32 and from the flow passage 56 which interconnects the first manifold chamber 48 and the second manifold chamber 50. Manifold fluid exit coupling 30 is arranged to receive static mixer 26 in a fluid tight connection through static mixer coupling 36.

Figure 4:
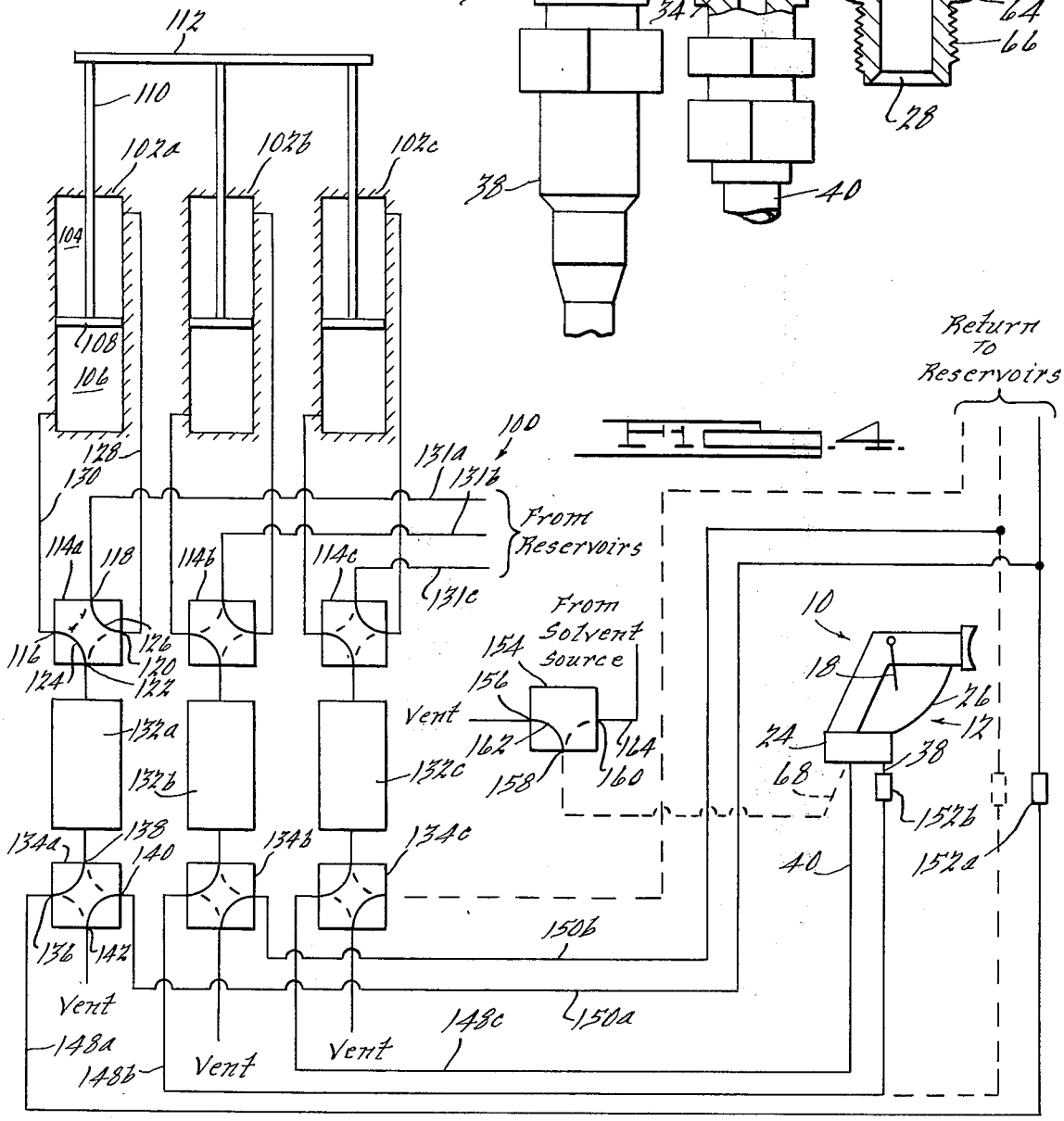
FIG. 4 is a schematic diagram of a fluid delivery system illustrating the operation of the present invention as applied to a paint spray operation.

Referring now to FIG. 4, a schematic diagram of a fluid delivery system 100 is shown to illustrate the operation of the present invention. For convenience, the source of atomizing air and the conduit communicating that source with the appropriate passage of the spray apparatus have not been included in this view. System 100 includes a plurality of pumping means in the form of cylinder members 102*a*, 102*b*, 102*c*. As used in FIG. 4 and throughout the remainder of this description, the suffix letters *a*, *b* and *c* designate components which are associated with the pumping cylinders 102*a*, 102*b* and 102*c*, respectively. Each cylinder member 102 has an upper pumping chamber 104 and a lower pumping chamber 106. The chambers 104, 106 are separated by a piston element 108. Each piston element 108 is connected by means of connecting rod 110 to a common connecting link 112. A four-way valve member 114 is associated with each cylinder 102. Each four-way valve member 114 is provided with four fluid ports designated by the numerals 116, 118, 120 and 122. Each four-way valve member 114 is also provided with a pair of internal valving passages 124, 126. The internal valving passages 124, 126 are operative to interconnect selected pairs of the valve ports 116, 118, 120, 122.

In the illustrated embodiment, valve passage 124 is arranged to intercommunicate valve port 122 with either valve port 116 or valve port 120. Valve passage 126 is arranged to intercommunicate valve port 118 with either valve port 120 or valve port 116. Valve port 120 is communicated to upper pumping chamber 104 by conduit 128 while valve port 116 is communicated to lower pumping chamber 106 by conduit 130. Each valve port 118 is connected to a fluid reservoir by a fluid conduit 131 These fluid reservoirs, not shown, may contain the various components of a multiple component coating. By way of example, the conduit 131*a* and 131*b* may communicate with reservoirs of fluid components having differing color properties and conduit 131*c* may communicate with a reservoir of cross-linker component. Each four-way valve port 122 is communicated to a flow regulator 132.

Each flow regulator 132 communicates with a further four-way valve member 134. Each of these further four-way valve members 134 has fluid ports 136, 138, 140, 142 and a pair of internal valving passages 144, 146. Each four-way valve member 134 is arranged to communicate with its associated regulator 132 through fluid port 138 and to communicate with its associated regulator 132 through fluid port 136. Each valve port 140 communicates with a fluid return line 150 and each valve port 142 communicates with a vent. The return lines 150 may be conveniently arranged to return the unused components to their respective reservoirs.

The spray apparatus supply lines 148*a* and 148*b* terminate in a quick connect coupling 152 which is adapted for attachment to fluid inlet coupling 38. In the embodiment illustrated in FIG. 4, spray apparatus supply conduit 148*a* has its quick disconnect coupling 152*a* coupled to the associated fluid return line 150*a* and spray apparatus supply conduit 148*b* is connected to provide a fluid flow to the inlet coupling 38 of the spray apparatus 10. Spray apparatus supply conduit 148*c* communicates with fluid conduit 40 (illustrated in FIGS. 1 and 2 and is here illustrated as being a fixed connection since the component provided by supply conduit 148*c* is common to both sprayable coatings in this illustrative embodiment. Fluid conduit 68 (as illustrated in phantom lines) is communicated with a three-way valve member 154 having three fluid ports 156, 158, 160 and a single valve passage 162. Valve passage 162 is arranged to intercommunicate valve port 158 with either of ports 156 or 160.

Fluid from each of the fluid reservoirs may be provided under pressure through the associated four-way valve members 114*a*, 114*b*, 114*c* to the upper chambers 104 of the associated cylinder members 102*a*, 102*b*, 102*c*. This pressure, applied against one face of each piston 108, is operative to displace each piston 108 downward and to expel any fluid accumulated within the lower chambers 106. This expelled fluid will flow through the respective four-way valve members 134*a*, 134*b*, 134*c*. In the illustrated embodiment, it is desired that spray apparatus 10 apply the color derived from the reservoir associated with cylinder member 102*b* and hence the fluid flow through four-way valve member 134*a* and through its associated supply hose 148*a* is communicated directly with the return lines. These return lines recirculate fluid back to the appropriate fluid reservoirs. However, the quick connect coupling 152*b* which is the termination of spray apparatus supply line 148*b* is connected to spray apparatus 10 so that fluid circulated through four-way valve member 134*b* will ultimately be sprayed by spray apparatus 10. Additionally, the fluid circulated through four-way valve member 134*c* will also be applied, through inlet conduit 40 of the spray apparatus 10 to be mixed by the apparatus of the present invention with the color-providing fluid supplied through spray apparatus conduit 148*b*.

As the piston members 108 reach the extreme limit of their down stroke, a switching mechanism, not shown, may be actuated and the four-way valve members 114 may be rapidly switched to their alternate position whereby fluid will be applied under pressure to pumping chambers 106 and fluid collected in chambers 104 will be displaced through the other valve channel to the four-way valve members 114 through the regulator means 132 to assure continuous fluid flow of the cross linking component and of the color components through their respective spray apparatus conduits 148.

When it is desired to change the color being applied by spray apparatus 10, the four-way valve members 134 may be switched to their alternate positions so that the fluids being circulated through regulator means 132 will be diverted through return lines 150 to be recirculated back to the fluid reservoirs. This switching will cause the inlets for each of the spray apparatus conduits 148 to be communicated to the vent ports 142 of the four-way valve members 134 to depressurize the spray apparatus supply conduit 148. Any fluid within the conduit 148 between the valve members 134 and the couplings 153, or the spray gun 10 in the case of conduit 148*c*, will remain in the conduits except for minor portions expelled by depressurization. At the same time, three-way valve member 154 may be actuated so that valve passage 162 intercommunicates the fluid conduit 68 with the port 160 of the valve 154. As illustrated in this Figure, port 160 of the three-way valve 154 communicates through conduit 164 with a source of solvent. While solvent conduit 68 has been illustrated and referred to as being fixedly coupled to manifold 24, it will be appreciated that an alternate arrangement would be to provide a quick disconnect coupling for supply conduit 68 and to connect that conduit, when desired, to inlet coupling 38.

Referring now to FIG. 2, it can be seen that as solvent flows through conduit 68 and enters the fluid passage means 58 of manifold member 24 it will be operative to remove any residual material situated within the passage means 58 and within the fluid chambers 48, 50 and static mixer means 26 to be exhausted from the spray apparatus 10 thereby completely cleansing the spray apparatus 10.

While solvent material is flowing through conduit 68 cleansing spray apparatus 10, quick disconnect coupling 152b may be removed from inlet coupling 38 and may be connected to its return line coupling. Thereafter quick disconnect coupling 152a may be removed from its return line coupling and applied to fluid inlet 38 of spray apparatus 10 to thereafter provide the component including the *a* color to be intermixed with the crosslinking component for application as a coating. The three-way valve member 154 may be actuated to terminate communication of the solvent conduit 164 with the valve port 158 and to communicate valve port 158 with the vent port 156 thereby depressurizing supply line 68 to permit the check valve member associated therewith to close. Actuation of four-way valve members 134 will return the fluid flows to the suppply lines 148 and the spray operation may be continued to apply the *a* color to the items being coated.

It is believed that the instant invention readily accomplishes its stated objectives. The total quantity of mixed and presprayed coating materials residing within spray-apparatus 10 at any one time is only that material within manifold chamber 48 and static-mixer means 26 and the short length of spray passage means of the spray apparatus 10 which is downstream from the sprayable material inlet coupling 22 thereof. This fluid is constantly in motion as a sprayable material whenever trigger mechanism 18 of the-spray apparatus 10 has been actuated. This quantity of mixed, and hence crosslinking, material will amount to only a few cubic centimeters of mixed and presprayed material and will have a very brief residence time within the spray apparatus so that any crosslinking which will occur in the material prior to its application as a coating will be negligable. Furthermore, the amount of solvent material which is required to flow through manifold passage means 58, static mixer 26-and spray apparatus 10 in order to accomplish a complete cleansing operation is only that quantity of solvent material necessary to dissolve and remove the-few cubic centimeters of mixed and presprayed material-residing within the spray apparatus-and such inadvertent and unintentional coating as may have occurred on the walls of passage means 58, static mixer 26, and the spray apparatus 10. Furthermore, the mass of material required to be added to a conventional air atomizing spray apparatus 10 to provide the mixing apparatus of the present invention is only that material necessary to provide for attachment of the necessary fluid inlet coupling, which may number two or three and the static mixer and its associated couplings.

I claim:

1. Apparatus for mixing the components of a multiple component sprayable fluid, attachable to an air atomizing spray gun of the type having a spray nozzle, an air passage communicating with the spray nozzle and arranged for communication with a source of pressurized gas and a sprayable fluid passage communicating with the air passage, comprising in combination:

a manifold member having a through passage and means for attachment to the air passage inlet to place said through passage in fluid tight communication with the air passage;

passage means extending through said manifold and having at least three fluid ports;

at least two of said manifold passage ports being adapted for fluid communication with separate reservoirs of the components of the sprayable fluid; and a static mixer means intercommunicating one of said fluid ports and the spray gun sprayable fluid passage port operative to intimately intermix the components of the sprayable fluid.

2. The apparatus of claim 1 wherein said manifold member passage means comprise a flow passage having a plurality of serially connected inlet ports, each of said inlet ports having a check valve means operative to permit fluid flow into said flow passage and to prevent fluid flow out of said flow passage.

3. The apparatus of claim 2 wherein said flow passage terminates in said static mixer communicating port.

4. Apparatus comprising in combination:

spray means having passage means adapted for fluid communication with a spray nozzle;

means defining a fluid flow passage having at least two fluid inlet couplings for receiving at least two separate and substantially simultaneous fluid flows, operative to combine said flows into a single fluid flow;

static mixer means for receiving said single fluid flow and operative to intimately intermix the fluids of said at least two fluid flows; and means for communicating said intimately intermixed fluid flow with said passage means of said spray means.

5. The apparatus of claim 4 wherein said spray apparatus is an air atomizing spray device and the passage means is in fluid communication with a source of pressurized air.

6. The apparatus of claim 5 wherein said means defining a fluid flow passage means comprise:

manifold means having a plurality of chambers;

a fluid passage interconnecting said chambers;

a plurality of fluid couplings connecting to said manifold and each coupling arranged to be in fluid communication with one of said chambers; and check valve means situated within at least one, and less than all, of said couplings, operative to permit fluid flow to enter the associated chamber through said check valve and to prevent fluid flow to pass through said check valve from the associated chamber.

7. The apparatus of claim 6 wherein said static mixer means is connected to said manifold means by one of said plurality of fluid couplings having check valve free fluid flow.

* * * * *